US010733939B2

(12) United States Patent
Xi et al.

(10) Patent No.: US 10,733,939 B2
(45) Date of Patent: Aug. 4, 2020

(54) PIXEL CIRCUIT, DISPLAY PANEL AND DRIVE METHOD FOR A PIXEL CIRCUIT

(71) Applicant: SHANGHAI TIANMA AM-OLED CO., LTD., Shanghai (CN)

(72) Inventors: Kerui Xi, Shanghai (CN); Junting Ouyang, Shanghai (CN); Baiquan Lin, Shanghai (CN); Tingting Cui, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/890,361

(22) Filed: Feb. 7, 2018

(65) Prior Publication Data

US 2018/0166021 A1 Jun. 14, 2018

(30) Foreign Application Priority Data

Aug. 15, 2017 (CN) ..... 2017 1 0697153

(51) Int. Cl.
*G09G 3/3291* (2016.01)
*G09G 3/3258* (2016.01)
(Continued)

(52) U.S. Cl.
CPC ..... *G09G 3/3291* (2013.01); *G09G 3/3233* (2013.01); *G09G 3/3241* (2013.01);
(Continued)

(58) Field of Classification Search
CPC ... G09G 2300/0819; G09G 2300/0842; G09G 2310/0262; G09G 2310/0272;
(Continued)

(56) References Cited

U.S. PATENT DOCUMENTS 7,180,486 B2 * 2/2007 Jeong ..... G09G 3/3233 345/76
7,564,452 B2 * 7/2009 Komiya ..... G09G 3/006 315/169.1
(Continued)

FOREIGN PATENT DOCUMENTS

CN 101866614 A 10/2010
CN 104409042 A 3/2015
CN 106997746 A 8/2017

*Primary Examiner* — Michael J Jansen, II
(74) *Attorney, Agent, or Firm* — Kilpatrick, Townsend & Stockton, LLP

(57) ABSTRACT

Disclosed are a pixel circuit, a display panel and a drive method for a pixel circuit. The pixel circuit comprises: a light-emitting element, configured for emitting light in response to a drive current; a drive transistor, configured for providing the drive current to the light-emitting element; a data write device, configured for writing a data signal to a gate electrode of the drive transistor; a hold device, electrically connected with the gate electrode of the drive transistor and configured for holding a voltage on the gate electrode of the drive transistor in a light-emitting stage; and a control device, electrically connected with the gate electrode of the drive transistor and configured for controlling the drive transistor to operate in a full cut-off region in a cut-off stage, wherein, the cut-off stage precedes the light-emitting stage.

14 Claims, 15 Drawing Sheets

(51) Int. Cl.
*G09G 3/3241* (2016.01)
*G09G 3/3233* (2016.01)

(52) U.S. Cl.
CPC ... *G09G 3/3258* (2013.01); *G09G 2300/0814* (2013.01); *G09G 2300/0819* (2013.01); *G09G 2300/0842* (2013.01); *G09G 2320/045* (2013.01); *G09G 2330/028* (2013.01)

(58) Field of Classification Search
CPC ..... G09G 2310/0289; G09G 2310/08; G09G 2320/0214; G09G 2320/0233; G09G 2320/0238; G09G 3/3233; G09G 3/3266; G09G 3/3275; G09G 2300/0814; G09G 2320/045; G09G 2330/028; G09G 3/3241; G09G 3/3258; G09G 3/3291; H01L 27/3276
See application file for complete search history.

(56) References Cited

U.S. PATENT DOCUMENTS 8,237,634 B2 * 8/2012 Kwak ..... G09G 3/3233 345/211
8,552,943 B2 * 10/2013 Chung ..... G09G 3/3233 345/82
8,692,821 B2 * 4/2014 Park ..... G09G 3/3233 345/211
8,803,770 B2 * 8/2014 Jeong ..... G09G 3/3233 345/76
8,810,139 B2 8/2014 Kim et al.
8,830,219 B2 * 9/2014 Choi ..... G09G 3/3233 345/211
8,976,166 B2 * 3/2015 Han ..... G09G 3/3233 345/208
8,982,017 B2 * 3/2015 Lee ..... G09G 3/3225 345/76
9,311,852 B2 * 4/2016 Wang ..... G09G 3/3233
9,384,700 B2 * 7/2016 Chen ..... G09G 3/3233
9,626,902 B2 * 4/2017 Kwon ..... G09G 3/3233
9,747,839 B2 * 8/2017 Wang ..... G09G 3/3233
9,972,242 B2 * 5/2018 Lim ..... G09G 3/3233
10,043,452 B2 * 8/2018 Jung ..... G09G 3/3258
10,083,658 B2 * 9/2018 Wang ..... G09G 3/3258
10,139,958 B2 * 11/2018 Ding ..... G09G 3/32
10,140,919 B2 * 11/2018 Nonaka ..... G09G 3/3233
10,140,928 B2 * 11/2018 Wang ..... G09G 3/3225
10,192,489 B1 * 1/2019 Liu ..... G09G 3/3258
10,629,130 B2 * 4/2020 Kim ..... G09G 3/3266
2006/0055336 A1 * 3/2006 Jeong ..... G09G 3/3233 315/169.3
2010/0013816 A1 * 1/2010 Kwak ..... G09G 3/3233 345/211
2010/0265166 A1 * 10/2010 Kang ..... G09G 3/3233 345/76
2011/0090200 A1 * 4/2011 Choi ..... G09G 3/3233 345/211
2011/0115772 A1 * 5/2011 Chung ..... G09G 3/3233 345/211
2011/0193856 A1 * 8/2011 Han ..... G09G 3/3233 345/214
2011/0273428 A1 * 11/2011 Han ..... G09G 3/3233 345/212
2012/0001893 A1 * 1/2012 Jeong ..... G09G 3/3233 345/213
2012/0062536 A1 * 3/2012 Park ..... G09G 3/3233 345/211
2013/0057532 A1 * 3/2013 Lee ..... G09G 3/3225 345/211
2013/0069852 A1 * 3/2013 Liao ..... G09G 3/3233 345/77
2014/0111503 A1 * 4/2014 Kwon ..... G09G 3/3233 345/213
2014/0132162 A1 * 5/2014 Kim ..... G09G 3/3266 315/161
2015/0221251 A1 * 8/2015 Wang ..... G09G 3/3233 345/690
2015/0356924 A1 * 12/2015 Chen ..... G09G 3/3233 345/690
2016/0267843 A1 * 9/2016 Wang ..... G09G 3/3233
2016/0372049 A1 * 12/2016 Wang ..... G09G 3/3233
2017/0116922 A1 * 4/2017 Jung ..... G09G 3/3258
2017/0153759 A1 * 6/2017 Ding ..... H01L 51/5225
2017/0270860 A1 * 9/2017 Wang ..... G09G 3/3233
2018/0061324 A1 * 3/2018 Kim ..... G09G 3/3275
2018/0122297 A1 * 5/2018 Nonaka ..... G09G 3/3233
2018/0315374 A1 * 11/2018 Zhang ..... G09G 3/3208
2019/0035332 A1 * 1/2019 Liu ..... G09G 3/3258

* cited by examiner

PIXEL CIRCUIT, DISPLAY PANEL AND DRIVE METHOD FOR A PIXEL CIRCUIT

CROSS-REFERENCE TO RELATED APPLICATIONS

This application claims priority to Chinese Patent Application No. 201710697153.X, filed on Aug. 15, 2017 and entitled "PIXEL CIRCUIT, DISPLAY PANEL AND DRIVE METHOD FOR A PIXEL CIRCUIT", the disclosure of which is incorporated herein by reference in its entirety.

TECHNICAL FIELD

The present disclosure relates to display technologies, and in particular, to a pixel circuit, a display panel and a drive method for a pixel circuit.

BACKGROUND

In comparison with liquid crystal displays, the organic light-emitting diodes of organic light-emitting displays have the advantages of low power consumption, low production cost, self-luminescence, wide visual angle and fast response speed, etc., and hence currently are widely applied in the display fields of mobile phones, PDAs, digital cameras and the like. Each pixel of the organic light-emitting display includes an organic light-emitting diode and a pixel circuit for driving the organic light-emitting diode to emit light for display.

A pixel circuit generally includes a drive transistor, a plurality of switch transistors and storage capacitors. Due to the manufacture process and device aging, etc., the characteristics of the drive transistor in the pixel circuit corresponding to the pixel may drift, for example, the threshold voltage may drift. Moreover, the drive transistor usually operates in a subthreshold region for a long time, which also tends to cause the characteristics of the drive transistor to drift. After the characteristics of the drive transistor drift, the characteristic curve may be twisted. The coincidence may not be completely realized even after a compensation, and thus the degrees of characteristic drifts for different drive transistors may be different, causing display mura and artifact, etc., so that the display effect of the whole image may be affected.

SUMMARY

Embodiments of the present disclosure provide a pixel circuit, a display panel and a drive method for a pixel circuit, thereby lowering the degree of characteristic drift of a drive transistor in a pixel circuit, thereby lowering the display mura and artifact, and improving the display effect.

One embodiment provides a pixel circuit, which includes: a light-emitting element, configured for emitting light in response to a drive current; a drive transistor, configured for providing the drive current to the light-emitting element; a data write device, configured for writing a data signal to a gate electrode of the drive transistor; a hold device, electrically connected with the gate electrode of the drive transistor and configured for holding a voltage on the gate electrode of the drive transistor in a light-emitting stage; and a control device, electrically connected with the gate electrode of the drive transistor and configured for controlling, in a cut-off stage, the drive transistor to operate in a full cut-off region, and the cut-off stage precedes the light-emitting stage.

One embodiment provides a display panel, which comprises the pixel circuit according to any of the embodiments of the disclosure.

One embodiment provides a drive method for a pixel circuit, which is configured for driving the pixel circuit according to any of the embodiments of the disclosure, including the following stages: a cut-off stage in which the control device is turned on, a cut-off signal is written to the gate electrode of the drive transistor, and thus the drive transistor operates in a full cut-off region; a data-write stage in which the control device is turned off, the data write device is turned on, and a data signal is written to the gate electrode of the drive transistor; and a light-emitting stage in which the drive transistor generates a drive current to drive the light-emitting element to emit light.

In one embodiment, the cut-off stage, the drive transistor operates in a full cut-off stage, that is, during one frame of display, the drive transistor operates in a full cut-off region in a part of the time period (corresponding to the cut-offstage), so that the magnitude of the voltage bias of the drive transistor is relatively low, thus lowering the degree of characteristic drift of the drive transistor, lowering the degree of twist of the characteristic curve, lowering the display mura and artifact, and improving the display effect of the picture.

DETAILED DESCRIPTION

The application will be illustrated in detail in conjunction with the drawings and embodiments. The drawings only show the parts related to the application, rather than the whole structure.

Figure 1A:
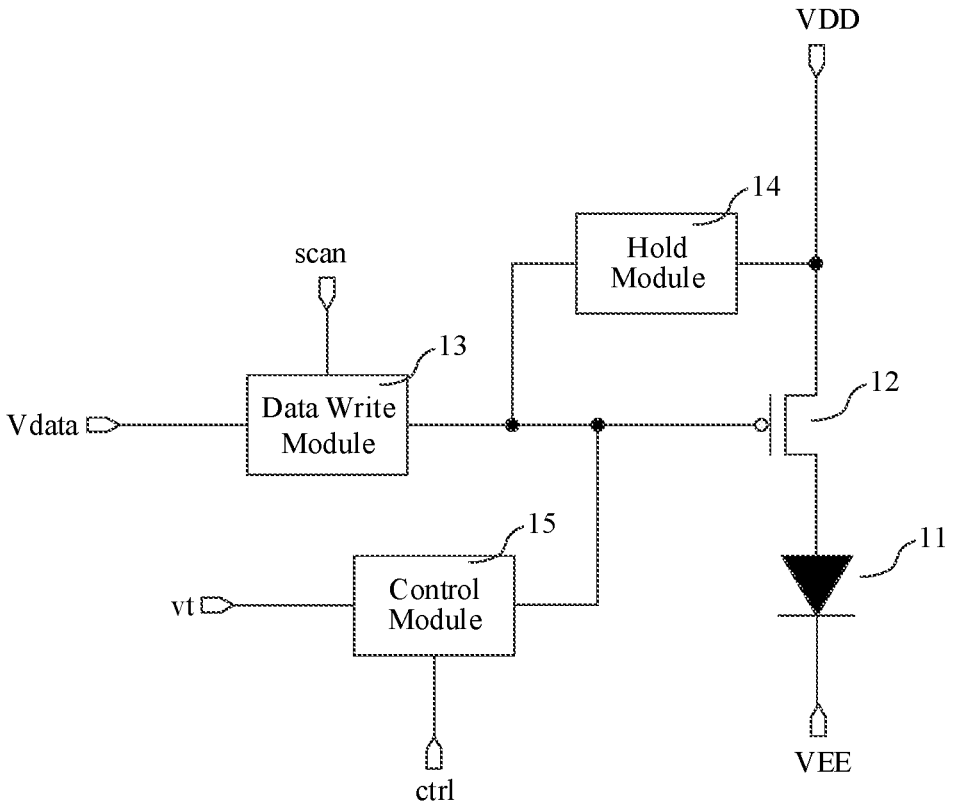
FIG. 1A is an electrical block diagram of a pixel circuit according to an embodiment of the disclosure.

FIG. 1A is an electrical block diagram of a pixel circuit according to an embodiment of the disclosure. Referring to FIG. 1A, the pixel circuit includes:

a light-emitting element 11, configured for emitting light in response to a drive current;

a drive transistor 12, configured for providing the drive current to the light-emitting element 11;

a data write device 13, configured for writing a data signal into a gate electrode of the drive transistor 12;

a hold device 14, electrically connected with the gate electrode of the drive transistor 12 and configured for holding the voltage of the gate electrode of the drive transistor 12 in a light-emitting stage;

a control device 15, electrically connected with the gate electrode of the drive transistor 12 and configured for controlling the drive transistor 12 to operate in a full cut-off region in a cut-off stage, and the cut-off stage precedes the light-emitting stage.

Specifically, in the cut-off stage, a control signal ctrl is written to the control terminal of the control device 15 so that the control device 15 is turned on, and a cut-off signal vt inputted on the input terminal thereof is written to the gate electrode of the drive transistor 12 in order to control the drive transistor 12 to operate in a full cut-off region. Then, the control device 15 is turned off according to the control signal written to its control terminal, a scan signal scan is written to the control terminal of the data write device 13, so that the data write device 13 is turned on, a data signal Vdata inputted on the input terminal thereof is written to the gate electrode of the drive transistor 12, and then the drive transistor 12 generates a corresponding drive current according to the data signal Vdata written to its gate electrode, so that the drive current drives the light-emitting element 11 to emit light to display. At the same time, the hold device 14 holds the voltage of the gate electrode of the drive transistor 12, and the drive transistor 12 continues generating the drive current to drive the light-emitting element 11 to continue emitting light.

In one embodiment, the drive transistor 12 may be an N-type transistor or a P-type transistor. If the drive transistor 12 is an N-type transistor, and the drive transistor 12 is intended to be controlled to operate in a full cut-off region, then the voltage difference between the gate electrode and the source electrode of the drive transistor 12 may be smaller than the negative value of the threshold voltage thereof. If the drive transistor 12 is a P-type transistor, and the drive transistor 12 is intended to be controlled to operate in a full cut-off region, then the voltage difference between the gate electrode and the source electrode of the drive transistor 12 may be larger than the negative value of the threshold voltage thereof. For example, for a P-type drive transistor with a threshold voltage of −2.791V, if the drive transistor is needed to operate in a full cut-off region, then the voltage difference between the gate electrode and the source electrode of the drive transistor may be 3V.

Figure 1B:
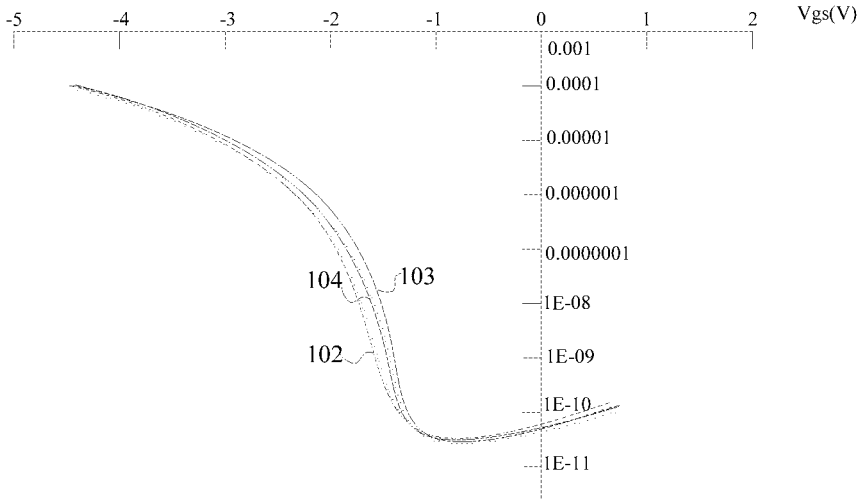
FIG. 1B is a characteristic curve contrast chart of a drive transistor according to an embodiment of the disclosure.

By the technical solution of the embodiments of the disclosure, because in the cut-off stage, the drive transistor operates in a full cut-off region, that is, during one frame of display, the drive transistor operates in a full cut-off region in a part of the time period (corresponding to the cut-off stage), so that the magnitude of voltage bias of the drive transistor is relatively low, and thus the degree of characteristic drift of the drive transistor may be lowered, thereby lowering the degree of twist of the characteristic curve, lowering the display mura and artifact, and improving the display effect of the picture. Exemplarily, referring to FIG. 1B, FIG. 1B is a characteristic curve contrast chart of a drive transistor according to an embodiment of the disclosure. The first curve 102 represents the original characteristic curve of the drive transistor, the second curve 103 represents the characteristic curve of the drive transistor after a characteristic drift occurs, and the third curve 104 represents the characteristic curve of the drive transistor when it operates in a full cut-off region in a part of the time period. It may be seen that, after the drive transistor operates in a full cut-off region in a part of the time period, the degree of characteristic drift of the third curve 104 is somewhat lowered relative to the degree of characteristic drift of the second curve 103, that is, when the drive transistor operates in a full cut-off region in a part of the time period, the degree of characteristic drift of the drive transistor may be lowered, and the display effect of the picture may be improved.

Figure 2A:
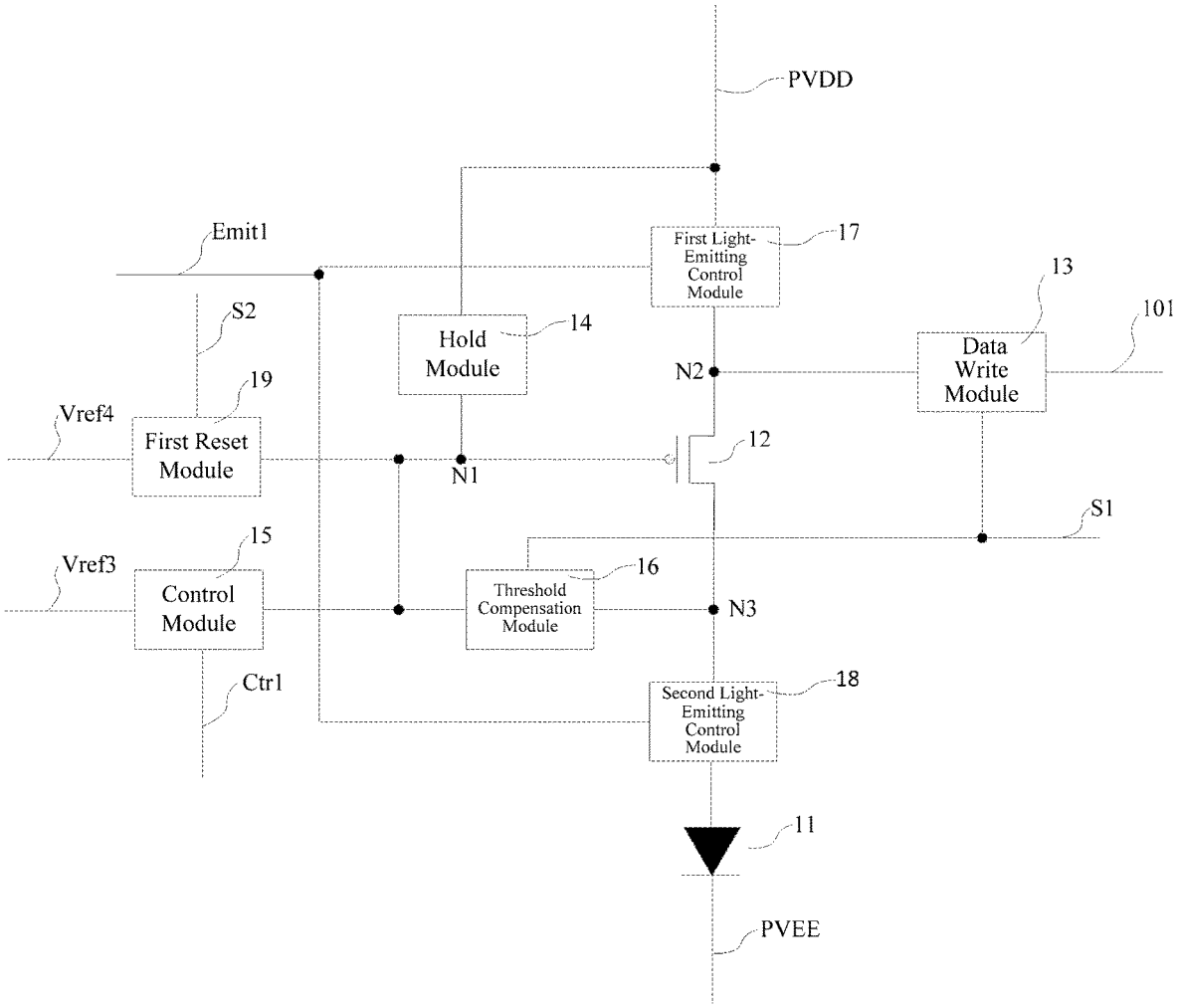
FIG. 2A is an electrical block diagram of another pixel circuit according to an embodiment of the disclosure.

FIG. 2A is an electrical block diagram of another pixel circuit according to an embodiment of the disclosure. Referring to FIG. 2A, the pixel circuit according to an embodiment of the disclosure includes a light-emitting element 11, a drive transistor 12, a data write device 13, a hold device 14, a control device 15, a threshold compensation device 16, a first light-emitting control device 17, a second light-emitting control device 18 and a first reset device 19.

A control terminal of the data write device 13 is electrically connected with a first scan line S1, a first terminal of the data write device 13 is electrically connected with a data line 101, and a second terminal of the data write device 13 is electrically connected with the first electrode of the drive transistor 12 (that is, a second node N2).

A control terminal of the threshold compensation device 16 is electrically connected with a first scan line S1, a first terminal of the threshold compensation device 16 is electrically connected with a second electrode of the drive transistor 12 (that is, a third node N3), and a second terminal of the threshold compensation device 16 is electrically connected with the gate electrode of the drive transistor 12 (that is, a first node N1).

A first terminal of the hold device 14 is electrically connected with the gate electrode of the drive transistor 12, and a second terminal of the hold device 14 is configured for inputting a fixed level signal and may be electrically connected with a first level signal line PVDD.

The control terminal of the control device 15 is electrically connected with a control signal line Ctrl, the first terminal of the control device 15 is electrically connected with a third level signal line Vref3, and the second terminal of the control device 15 is electrically connected with the gate electrode of the drive transistor 12;

The control terminal of the first light-emitting control device 17 is electrically connected with a first light-emitting signal line Emit1, the first terminal of the first light-emitting control device 17 is electrically connected with a first level signal line PVDD, and the second terminal of the first light-emitting control device 17 is electrically connected with the first electrode of the drive transistor 12;

The control terminal of the second light-emitting control device 18 is electrically connected with the first light-emitting signal line Emit1, the first terminal of the second light-emitting control device 18 is electrically connected with the second electrode of the drive transistor 12, and the second terminal of the second light-emitting control device 18 is electrically connected with the first electrode of the light-emitting element 11;

The second electrode of the light-emitting element 11 is electrically connected with a second level signal line PVEE;

The control terminal of the first reset device 19 is electrically connected with a second scan line S2, the first terminal of the first reset device 19 is electrically connected with a fourth level signal line Vref4, the second terminal of the first reset device 19 is electrically connected with the gate electrode of the drive transistor 12.

Exemplarily, in one frame of display, in a first stage (which is also referred to as a cut-offstage), a first light-emitting signal on the first light-emitting signal line Emit1 is written to the control terminal of the first light-emitting control device 17 and the control terminal of the second light-emitting control device 18, and hence the first light-emitting control device 17 and the second light-emitting control device 18 are turned on. A control signal on the control signal line Ctrl is written to the control terminal of the control device 15, and hence the control device 15 is turned on. A third level signal on the third level signal line Vref3 is written to the gate electrode of the drive transistor 12, and hence the drive transistor 12 operates in a full cut-off region. In a second stage (which is also referred to as an initialization stage), the control device 15 is turned off, the first light-emitting control device 17 and the second light-emitting control device 18 are also turned off; a second scan signal on the second scan line S2 is written to the control terminal of the first reset device 19, so that the first reset device 19 is turned on; a fourth level signal on the fourth level signal line Vref4 is written to the gate electrode of the drive transistor 12 and the first terminal of the hold device 14, and hence the voltage on the gate electrode of the hold device 14 and the voltage on the first terminal of the hold device 14 are reset. In a third stage (which is also referred to as a data-write stage), the first reset device 19 is turned off, a first scan signal on the first scan line S1 is written to the control terminal of the data write device 13, the data write device 19 and the threshold compensation device 16 are turned on, and the data signal on the data line 101 successively passes through the data write device 19, the drive transistor 12 and the threshold compensation device 16 and then is written to the gate electrode of the drive transistor 12, and the voltage on the gate electrode of the drive transistor rises until the drive transistor is turned off. It is provided that the voltage value of the data signal on the data line 101 is $V_{data}$, when the drive transistor 12 is turned off, the gate voltage of the hold device 14, i.e., the voltage $V_1$ of the first node N1 equals to $V_{data}+V_{th}$, and $V_{th}$ is the threshold voltage of the drive transistor 12. In a fourth stage (which is also referred to as a light-emitting stage), the data write device 13 and the threshold compensation device 16 are turned off, the light-emitting signal on the first light-emitting signal line Emit1 is written to the control terminal of the first light-emitting control device 17 and the control terminal of the second light-emitting control device 18, and the first light-emitting control device 17 and the second light-emitting control device 18 are turned on; a drain current $I_d$ of the drive transistor 12, i.e., the drive current, drives the light-emitting element 11 to emit light via the second light-emitting control device 18, thereby realizing the display function of the display panel. The drive current $I_d$ meets the formula below:

$$\begin{aligned} I_d &= \frac{1}{2}\mu C_{ox}\frac{W}{L}(V_{gs}-V_{th})^2 \\ &= \frac{1}{2}\mu C_{ox}\frac{W}{L}(V_1-V_{PVDD}-V_{th})^2 \\ &= I_d \end{aligned}$$

Figure 2B:
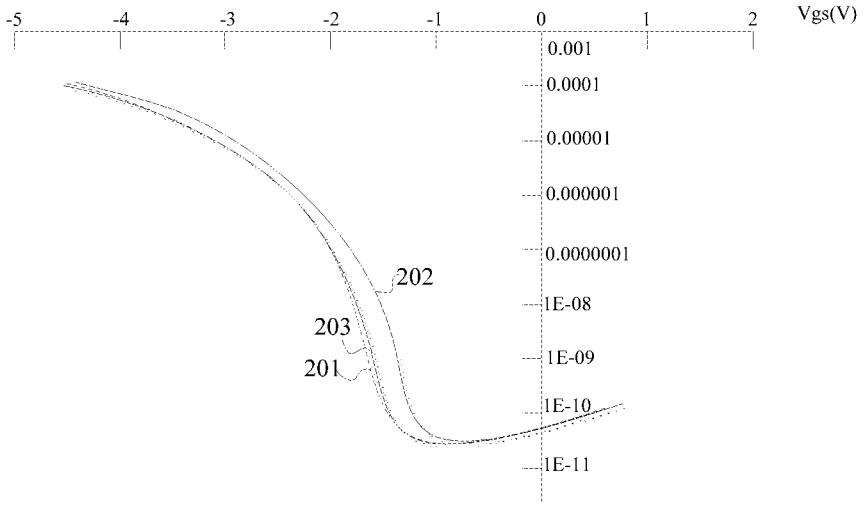
FIG. 2B is a characteristic curve contrast chart of another drive transistor according to an embodiment of the disclosure.

-continued $$\begin{aligned} &= \frac{1}{2}\mu C_{ox}\frac{W}{L}(V_{gs}-V_{th})^2 \\ &= \frac{1}{2}\mu C_{ox}\frac{W}{L}(V_{data}+V_{th}-V_{PVDD}-V_{th})^2 \\ &= \frac{1}{2}\mu C_{ox}\frac{W}{L}(V_{data}-V_{PVDD})^2 \end{aligned}$$

and μ is the carrier mobility of the drive transistor 12, W, L is the width and length of a channel of the drive transistor 12, $C_{ox}$ is the gate oxide layer capacitance, per unit area, of the drive transistor 12. $V_{PVDD}$ is the voltage value of the first level signal on the first level signal line PVDD, and is also the voltage value of the second node N2. It may be seen that, the drive current $I_d$ generated by the drive transistor 12 is independent of the threshold voltage $V_{th}$ of the drive transistor 12. Therefore, the problem of abnormal display caused by the threshold voltage drift of the drive transistor 12 may be solved. Moreover, because in the cut-off stage, the drive transistor 12 operates in a full cut-off region, the degree of characteristic drift of the drive transistor 12 may be lowered, display mura and artifact may be lowered, and the display quality may be improved. FIG. 2B is a characteristic curve contrast chart of a drive transistor according to an embodiment of the disclosure. Referring to FIG. 2B, the first curve 201 may represent the original characteristic curve of the drive transistor, the second curve 202 may represent the characteristic curve of the drive transistor after characteristic drift occurs, and the third curve 203 may represent the characteristic curve after the drive transistor operates in a full cut-off region and then threshold compensation is further performed on the drive transistor. It may be seen that the third curve 203 almost coincides with the first curve 201 after the threshold compensation. In the full cut-off region, the first curve 201, the second curve 202 and the third curve 203 are highly coincided with each other. In this case, in one frame of display, the drive transistor 12 is controlled by the control device 15 to operate in a full cut-off region in a part of the time period (the cut-off stage), so that the degree of characteristic drift of the drive transistor 12 may be lowered, the compensation effect may be improved, thereby further lowering the display mura and artifact, and improving the display effect.

Figure 2C:
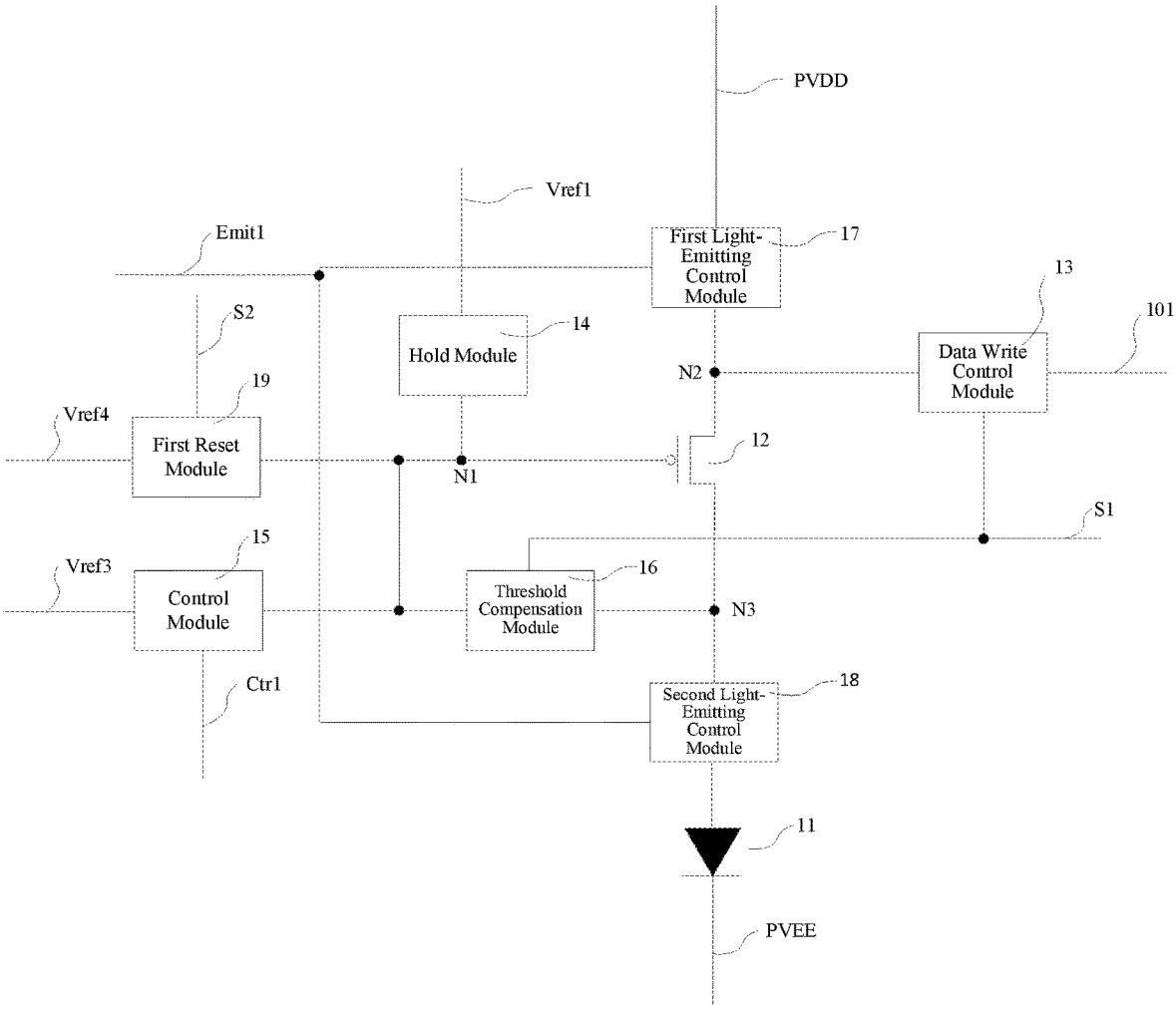
FIG. 2C is an electrical block diagram of another pixel circuit according to an embodiment of the disclosure.

In an embodiment of the disclosure, the second terminal of the hold device 14 is configured for inputting a fixed level signal as a reference voltage, in order to hold the voltage on the second terminal thereof. As shown in FIG. 2A, the second terminal of the hold device 14 is electrically connected with the first level signal line PVDD, the fixed level signal provided by the first level signal line PVDD is regarded as the reference voltage. In other embodiments of the disclosure, the second terminal of the hold device 14 may be electrically connected with other level signal lines. Referring to FIG. 2C, FIG. 2C is an electrical block diagram of another pixel circuit according to an embodiment of the disclosure. As different from the pixel circuit shown in FIG. 2A, the second terminal of the hold device 14 is electrically connected with a reference voltage signal line Vref1 which provides a fixed voltage signal. In FIG. 2A, the second terminal of the hold device 14 is electrically connected with the first level signal line PVDD, and no additional reference voltage signal line may be provided.

In an embodiment of the disclosure, the voltage value of the signal on the third level signal line Vref3 may be larger than the voltage value of the signal on the first level signal line PVDD. For example, the first scan signal on the first scan line S1 may include a high-level stage and a low-level stage, the voltage value of the signal on the first level signal line Vref3 may be equal to the voltage value of the high-level stage of the first scan signal. In the cut-off stage, the signal on the third level signal line Vref3 is written to the gate electrode of the drive transistor 12, the signal on the first level signal line PVDD is written to the first electrode of the drive transistor 12, and the voltage value of the signal on the third level signal line Vref3 is larger than the voltage value of the signal on the first level signal line PVDD. Specifically, the difference between the voltage value of the signal on the third level signal line Vref3 and the voltage value of the signal on the first level signal line PVDD may be larger than the negative value of the threshold voltage of the drive transistor, so that the drive transistor 12 may operate in a full cut-off region.

FIG. 2C is a circuit diagram of a pixel circuit according to an embodiment of the disclosure. Based on the pixel circuit according to any embodiment of the disclosure, the data write device 13 includes a first transistor M1, the threshold compensation device 16 includes a second transistor, the control device 15 includes a third transistor M3, the first light-emitting control device 17 includes a fourth transistor M4, the second light-emitting control device 18 includes a fifth transistor M5, the first reset device 19 includes a sixth transistor M6, and the hold device 14 includes a first capacitor Cst;

The first electrode of the first transistor M1 is electrically connected with a data line 101, the second electrode of the first transistor M1 is electrically connected with the first electrode of the drive transistor 12 (that is, the second node N2), and the gate electrode of the first transistor M1 is electrically connected with the first scan line S1.

The first electrode of the second transistor M2 is electrically connected with the second electrode of the drive transistor 12 (that is, the third node N3), the second electrode of the second transistor M2 is electrically connected with the first electrode of the drive transistor 12 (that is, the first node N1), and the gate electrode of the second transistor M2 is electrically connected with the first scan line S1.

The first electrode of the third transistor M3 is electrically connected with a third level signal line Vref3, the second electrode of the third transistor M3 is electrically connected with the gate electrode of the drive transistor 12, and the gate electrode of the third transistor M3 is electrically connected with a control signal line Ctrl.

The first electrode of the fourth transistor M4 is electrically connected with the first level signal line PVDD, the second electrode of the fourth transistor M4 is electrically connected with the first electrode of the drive transistor 12, and the gate electrode of the fourth transistor M4 is electrically connected with the first light-emitting signal line Emit1.

The first electrode of the fifth transistor M5 is electrically connected with the second electrode of the drive transistor 12, the second electrode of the fifth transistor M5 is electrically connected with the first electrode of the light-emitting element 11, and the gate electrode of the fifth transistor M5 is electrically connected with the first light-emitting signal line Emit1.

The first electrode of the sixth transistor M6 is electrically connected with the fourth level signal line Vref4, the second electrode of the sixth transistor M6 is electrically connected with the gate electrode of the drive transistor 12, and the gate electrode of the sixth transistor M6 is electrically connected with the second scan line S2;

The first electrode of the first capacitor Cst is electrically connected with the gate electrode of the drive transistor 12, and the second electrode of the first capacitor Cst is electrically connected with the first electrode of the drive transistor 12.

Figure 2D:
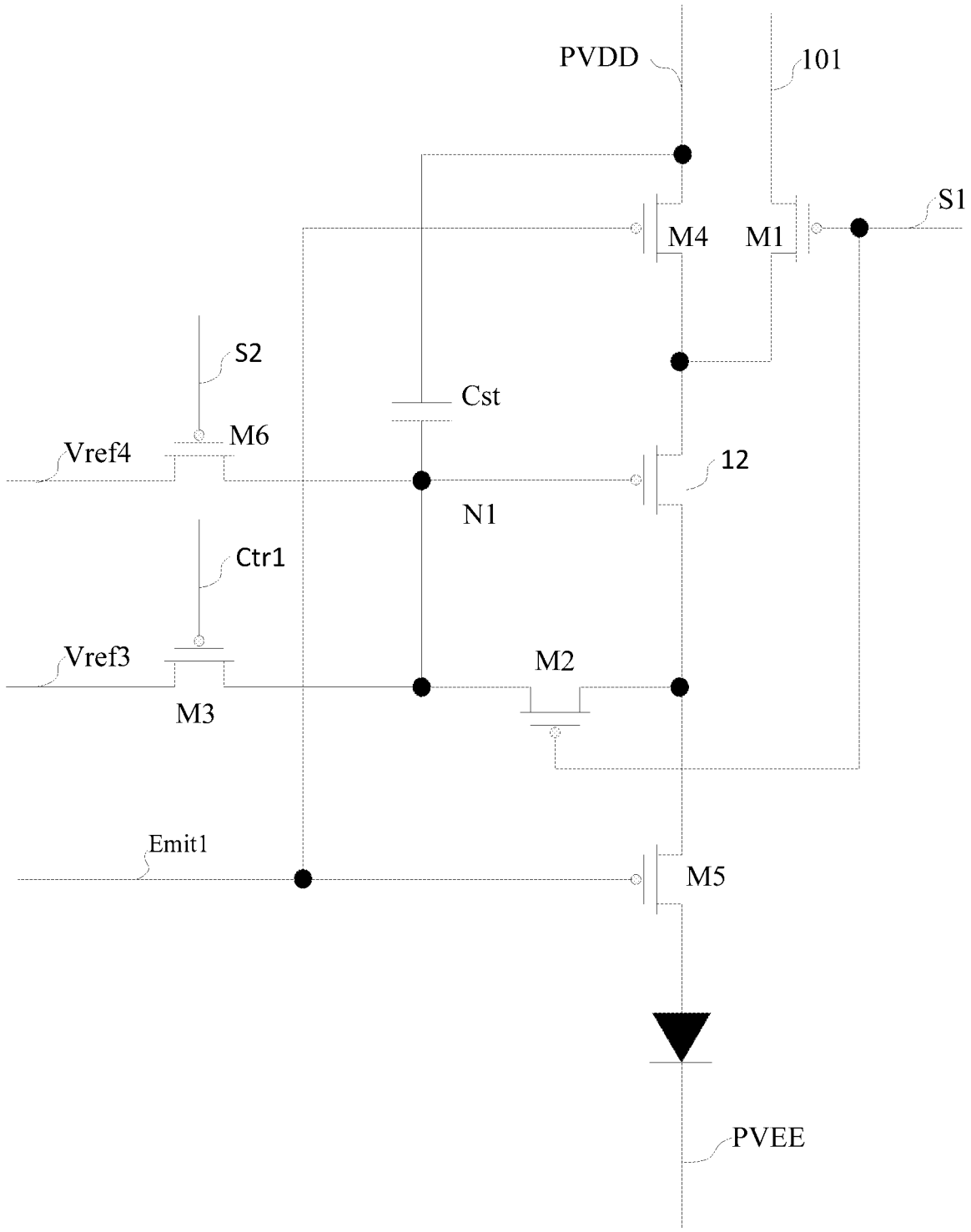
FIG. 2D is a circuit diagram of a pixel circuit according to an embodiment of the disclosure.
Figure 2E:
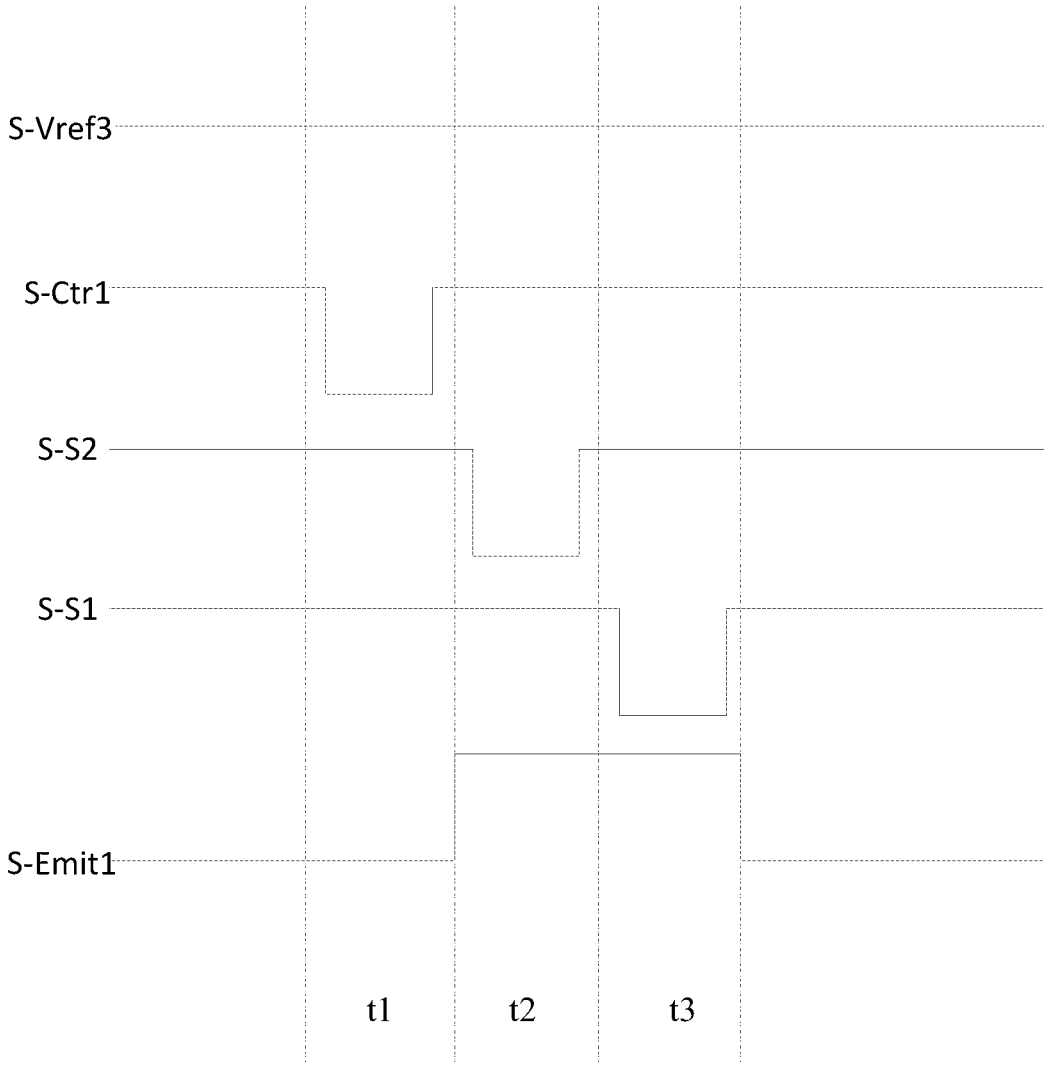
FIG. 2E is a drive timing diagram according to an embodiment of the disclosure.

FIG. 2E is a drive timing diagram according to an embodiment of the disclosure. An operating process of a pixel circuit according to an embodiment of the disclosure may be illustrated exemplarily below in conjunction with FIG. 2D and FIG. 2E. S-S1 represents the first scan signal on the first scan line S1, S-S2 represents the second scan signal on the second scan line S2, S-Emit1 represents the first light-emitting signal on the first light-emitting signal line Emit1, S-Ctrl represents the control signal on the control signal line Ctrl, S-Vref represents the third level signal on the third level signal line, which is at a high level. The first level signal on the first level signal line PVDD is at a high level, and the second level signal on the second level signal line PVEE is at a low level. Each of the transistors is a P-type transistor. The operating process of the pixel circuit includes the stages below:

a t1 stage where the first light-emitting signal Emit1 is at a low level, and the fourth transistor M4 and the fifth transistor M5 are turned on. The control signal S-Ctrl is at a low level, the third transistor M3 is turned on, the third level signal S-Vref is written to the gate electrode of the drive transistor 12, the first electrode of the first capacitor Cst and the gate electrode of the drive transistor 12. Because the fourth transistor M4 is turned on, the first level signal on the first level signal line PVDD is written to the first stage of the drive transistor 12, i.e., the source electrode of the drive transistor 12, and the drive transistor 12 operates in a full cut-off region. This stage is also referred to as a cut-off stage;

a t2 stage where the first light-emitting signal Emit1 is at a high level, and the fourth transistor M4 and the fifth transistor M5 are turned off. The control signal S-Ctrl is at a high level, and the third transistor M3 is turned off. The second scan signal S-S2 is at a low level, the sixth transistor M6 is turned on, the fourth level signal S-Vref is written to the gate electrode of the drive transistor 12 and the first electrode of the first capacitor Cst; in this stage, the fourth level signal S-Vref may be a low level signal to reset the voltages on the gate electrode of the drive transistor 12 and the first electrode of the first capacitor Cst, thereby guaranteeing that the drive transistor 12 is turned on in the next stage, and a data signal can be written to the gate electrode of the drive transistor 12, and this stage may also be referred to as an initialization stage;

t3 stage where the fourth transistor M4, the fifth transistor M5 and the third transistor M3 are turned off. The second scan signal S-S2 is at a high level, and the sixth transistor M6 is turned off. The first scan signal S-S1 is at a low level, the first transistor M1 and the second transistor M2 are turned on, and the data signal on the data line 101 successively passes through the first transistor M1, the drive transistor 12 and the second transistor M2 and then is written to the gate electrode of the drive transistor 12 and the first electrode of the first capacitor Cst, the gate voltage of the hold device 14 rises gradually until the difference between voltages on the gate electrode and the source electrode of the hold device 14 is equal to the threshold voltage of the drive transistor 12, and then the drive transistor 12 is turned off, the voltage on the gate electrode of the drive transistor 12 is kept unchanged, and the voltage $V_1$ on the gate electrode of the drive transistor 12, i.e., the voltage on the first node N1, is equal to $V_{data}+V_{th}$, and $V_{data}$ is the voltage value of the data signal on the data line 101, and $V_{th}$ is the threshold voltage of the drive transistor 12;

a stage after t3, which is also referred to as a light-emitting stage where the first light-emitting signal Emit1 is at a low level, and the fourth transistor M4 and the fifth transistor M5 are turned on. The first scan signal S-S1 is at a high level, the first transistor M1 and the second transistor M2 are turned off, and the third transistor M3 and the sixth transistor M6 are also turned off. The drain current of the drive transistor 12, i.e., the drive current generated by the drive transistor 12, drives the light-emitting element 11 to emit light, and the drive current $I_d$ meets the formula below:

$$\begin{aligned} I_d &= \frac{1}{2}\mu C_{ox}\frac{W}{L}(V_{gs}-V_{th})^2 \\ &= \frac{1}{2}\mu C_{ox}\frac{W}{L}(V_1-V_{PVDD}-V_{th})^2 \\ &= I_d \\ &= \frac{1}{2}\mu C_{ox}\frac{W}{L}(V_{gs}-V_{th})^2 \\ &= \frac{1}{2}\mu C_{ox}\frac{W}{L}(V_{data}+V_{th}-V_{PVDD}-V_{th})^2 \\ &= \frac{1}{2}\mu C_{ox}\frac{W}{L}(V_{data}-V_{PVDD})^2 \end{aligned}$$

and $V_{PVDD}$ is the voltage value of the first level signal on the first level signal line PVDD, that is, the voltage value of the second node N2. It may be seen that, the drive current $I_d$ generated by the drive transistor 12 is independent from the threshold voltage $V_{th}$ of the drive transistor 12. The problem of abnormal display caused by the threshold voltage drift of the drive transistor 12 may be solved; moreover, in the cut-offstage, the drive transistor 12 operates in a full cut-off region, so that the degree of characteristic drift of the drive transistor 12 may be lowered, thereby lowering the display mura and artifact, and improving the display quality.

Figure 3A:
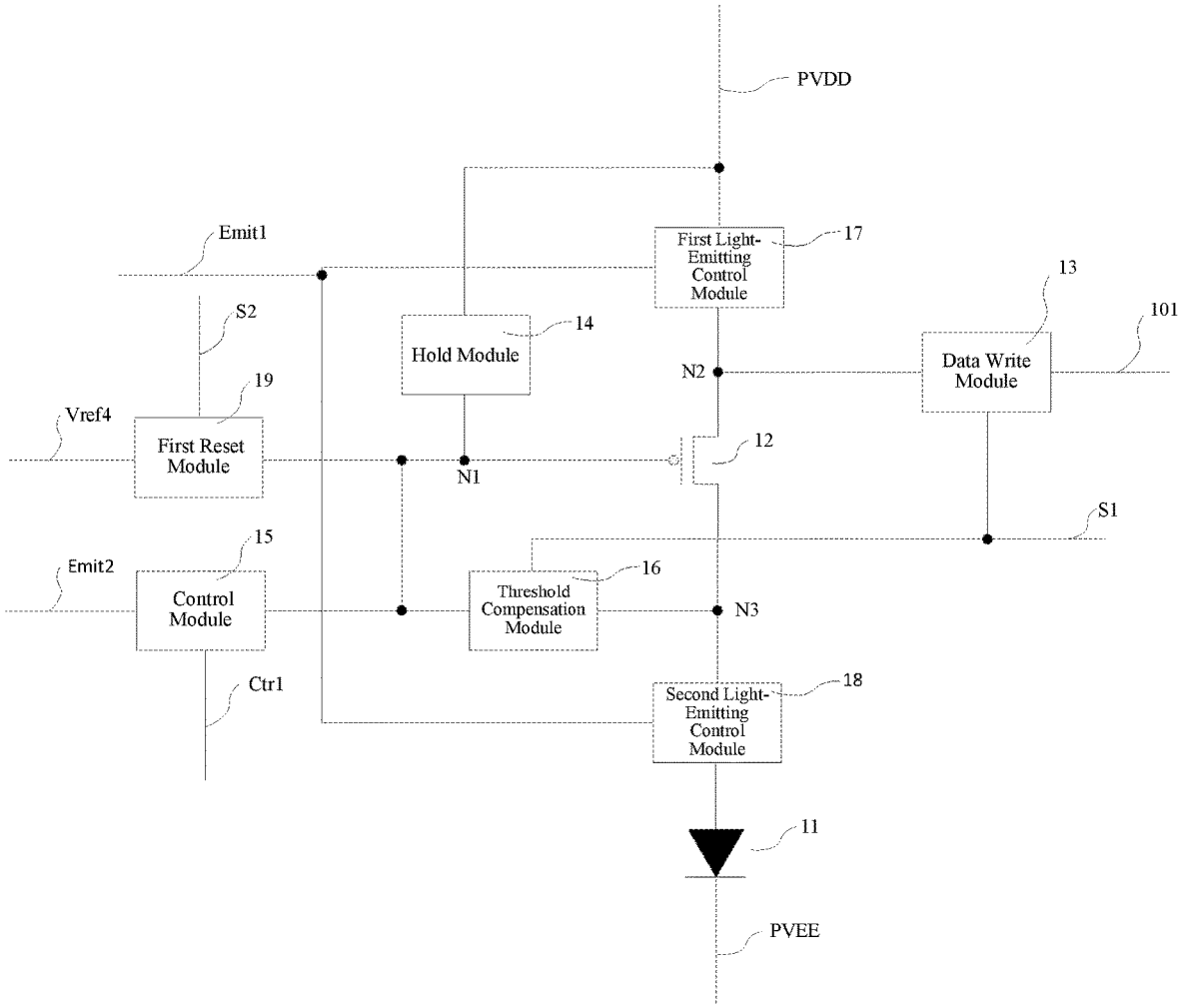
FIG. 3A is an electrical block diagram of another pixel circuit according to an embodiment of the disclosure.

FIG. 3A is an electrical block diagram of another pixel circuit according to an embodiment of the disclosure. Referring to FIG. 3A, the pixel circuit according to an embodiment of the disclosure includes a light-emitting element 11, a drive transistor 12, a data write device 13, a hold device 14, a control device 15, a threshold compensation device 16, a first light-emitting control device 17, a second light-emitting control device 18 and a first reset device 19.

The control terminal of the data write device 13 is electrically connected with the first scan line S1, the first terminal thereof is electrically connected with a data line 101, and the second terminal thereof is electrically connected with the first electrode of the drive transistor 12.

The control terminal of the threshold compensation device 16 is electrically connected with the first scan line S1, the first terminal thereof is electrically connected with the second electrode of the drive transistor, and the second terminal thereof is electrically connected with the gate electrode of the drive transistor.

The first terminal of the hold device 14 is electrically connected with the gate electrode of the drive transistor 12, and the second terminal of the hold device is configured for inputting a fixed level signal.

The control terminal of the control device 15 is electrically connected with a control signal line Ctrl, the first terminal thereof is electrically connected with the second light-emitting signal line Emit2, and the second terminal thereof is electrically connected with the gate electrode of the drive transistor 12.

The control terminal of the first light-emitting control device 17 is electrically connected with the first light-emitting signal line Emit1, the first terminal thereof is electrically connected with the first level signal line PVDD, and the second terminal thereof is electrically connected with the first electrode of the drive transistor 12.

The control terminal of the second light-emitting control device 18 is electrically connected with the first light-emitting signal line Emit1, the first terminal thereof is electrically connected with the second electrode of the drive transistor 12, and the second terminal thereof is electrically connected with the first electrode of the light-emitting element 11.

The second electrode of the light-emitting element 11 is electrically connected with the second level signal line PVEE.

The control terminal of the first reset device 19 is electrically connected with the second scan line S2, the first terminal thereof is electrically connected with the fourth level signal line Vref4, and the second terminal thereof is electrically connected with the gate electrode of the drive transistor 12.

As different from the pixel circuit shown in FIG. 2A, in the pixel circuit shown in FIG. 3A, the first terminal of the control device 15 is electrically connected with the second light-emitting signal line Emit2, and in the cut-off stage, a voltage is provided on the second light-emitting signal line Emit2 to control the drive transistor 12 to operate in a full cut-off region.

In an embodiment of the disclosure, the signals on the first light-emitting signal line Emit1 and the second light-emitting signal line Emit2 are both impulse signals.

The signal on the second light-emitting signal line Emit2 is a signal immediately preceding to the signal on the first light-emitting signal line Emit1.

Specifically, the first light-emitting signal line Emit1 and the second light-emitting signal line Emit2 may be electrically connected with a output terminal of a light-emitting signal drive circuit (EOA) on a display panel, and the EOA circuit is located in a non-display region of the display panel, and hence may be located on one side or two opposite sides of the display region of the display panel. The EOA circuit charges the first light-emitting signal line Emit1, i.e., provides a first light-emitting signal, and charges the second light-emitting signal line Emit2, i.e., provides a second light-emitting signal. The first light-emitting signal line Emit1 and the second light-emitting signal line Emit2 may be adjacent two signal lines. After the EOA circuit provides the second light-emitting signal to the second light-emitting signal line Emit2 to charges the second light-emitting signal line Emit2, it immediately turns to provide the first light-emitting signal to the first light-emitting signal line Emit1, and the second light-emitting signal is a signal immediately preceding to the first light-emitting signal. That is, the impulse signal on the first light-emitting signal line Emit1 has the same amplitude with, but different phases from the impulse signal on the second light-emitting signal line Emit2. The first terminal of the control device 15 is electrically connected with the second light-emitting signal line Emit2, and the third level signal line is replaced by the second light-emitting signal line Emit2, so that the third level signal line may be saved, and hence the wiring space in the display panel may be saved, and the cost may be lowered.

The voltage value of the high-level signal on the second light-emitting signal line Emit2 is larger than the voltage value of the signal on the first level signal line PVDD. In the cut-off stage, the voltage of the high-level signal on the second light-emitting signal line Emit2 is written to the gate electrode of the drive transistor 12 and the voltage of the signal on the first level signal line PVDD is written to the first electrode of the drive transistor 12, the voltage value of the high-level signal on the second light-emitting signal line Emit2 is larger than the voltage value of the signal on the first level signal line PVDD. Specifically, the difference between the voltage value of the signal on the third level signal line Vref3 and the voltage value of the signal on the first level signal line PVDD may be larger than the negative value of the threshold voltage of the drive transistor, so that the drive transistor 12 may operate in a full cut-off region.

Figure 3B:
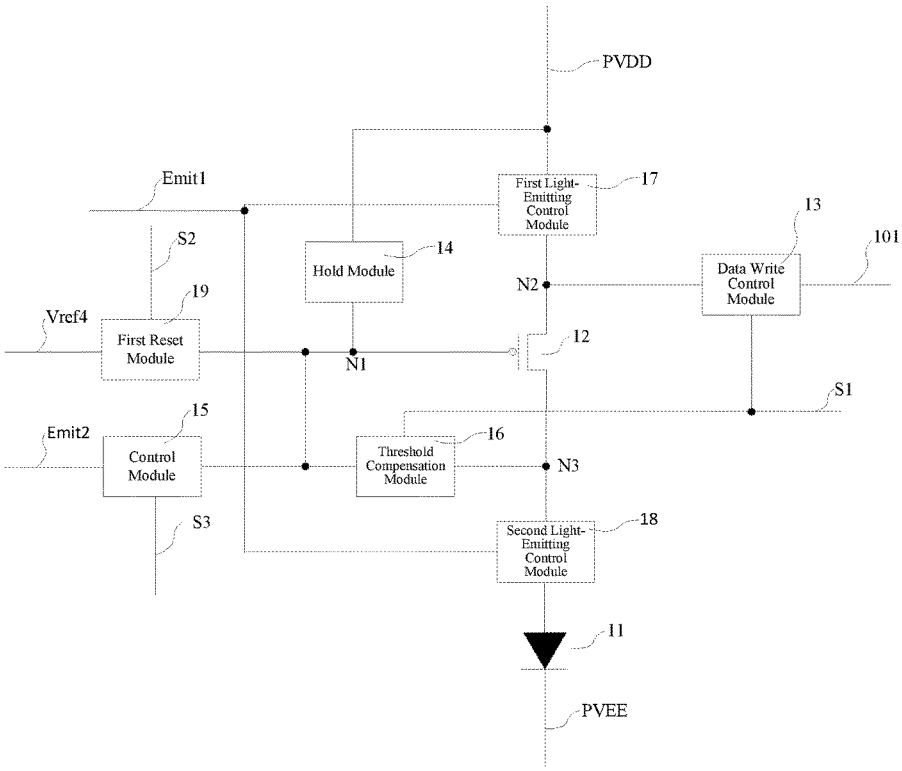
FIG. 3B is an electrical block diagram of another pixel circuit according to an embodiment of the disclosure.

FIG. 3B is an electrical block diagram of another pixel circuit according to an embodiment of the disclosure. In another embodiment of the disclosure, referring to FIG. 3B, the control terminal of the control device is electrically connected with a third scan line S3, the signal on the third scan line S3 is an impulse signal, and the signal on the third scan line S3 is a signal immediately preceding to the signal on the second scan line, the third scan line S3 is reused as the control signal line.

The signals on the control signal line, the first scan line S1 and the second scan line S2 are all impulse signals; the signal on the second scan line S2 is a signal immediately preceding to the signal on the first scan line S1.

Specifically, the first scan line S1, the second scan line S2 and the third scan line S3 may be electrically connected with the output terminal of a scanning drive circuit on the display panel, which is also referred to as a gate drive circuit (GOA). The GOA circuit is located in a non-display region of the display panel, and hence may be located on one side or two opposite sides of the display region of the display panel. The GOA circuit charges the first scan line S1, i.e., provides a first scan signal, and charges the second scan line S2, i.e., provides a second scan signal, and charges the third scan line S3, i.e., provides a third scan signal. The first scan line S1, the second scan line S2 and the third scan line S3 are successively arranged side by side. After the GOA circuit provides the third scan signal to the third scan line S3 to charge the third scan line S3, it immediately turns to provide a second scan signal to the second scan line S2 to charge the second scan line S2, and then it immediately turns to provide a first scan signal to the first scan line S1. The third scan signal is a signal immediately preceding to the second scan signal, and the second scan signal is a signal immediately preceding to the first scan signal. That is, the amplitudes of the first scan signal, the second scan signal and the third scan signal are the same, but the phases thereof are different. The third scan signal line S3 is reused as the control signal line, and thus the control signal line may not be needed, and the wiring space may be saved on the basis that the normal operation of the circuit is guaranteed.

In the pixel circuit shown in FIG. 3A and FIG. 3B, the third level signal line Vref3 is replaced by the second light-emitting signal line Emit2, and the control signal line Ctrl is replaced by the third scan line S3, so that no third level signal line or control signal line Ctrl may be provided additionally, and hence no corresponding drive signal may be designed or provided. As a result, the wiring space may be saved, and the cost may be lowered.

Figure 3C:
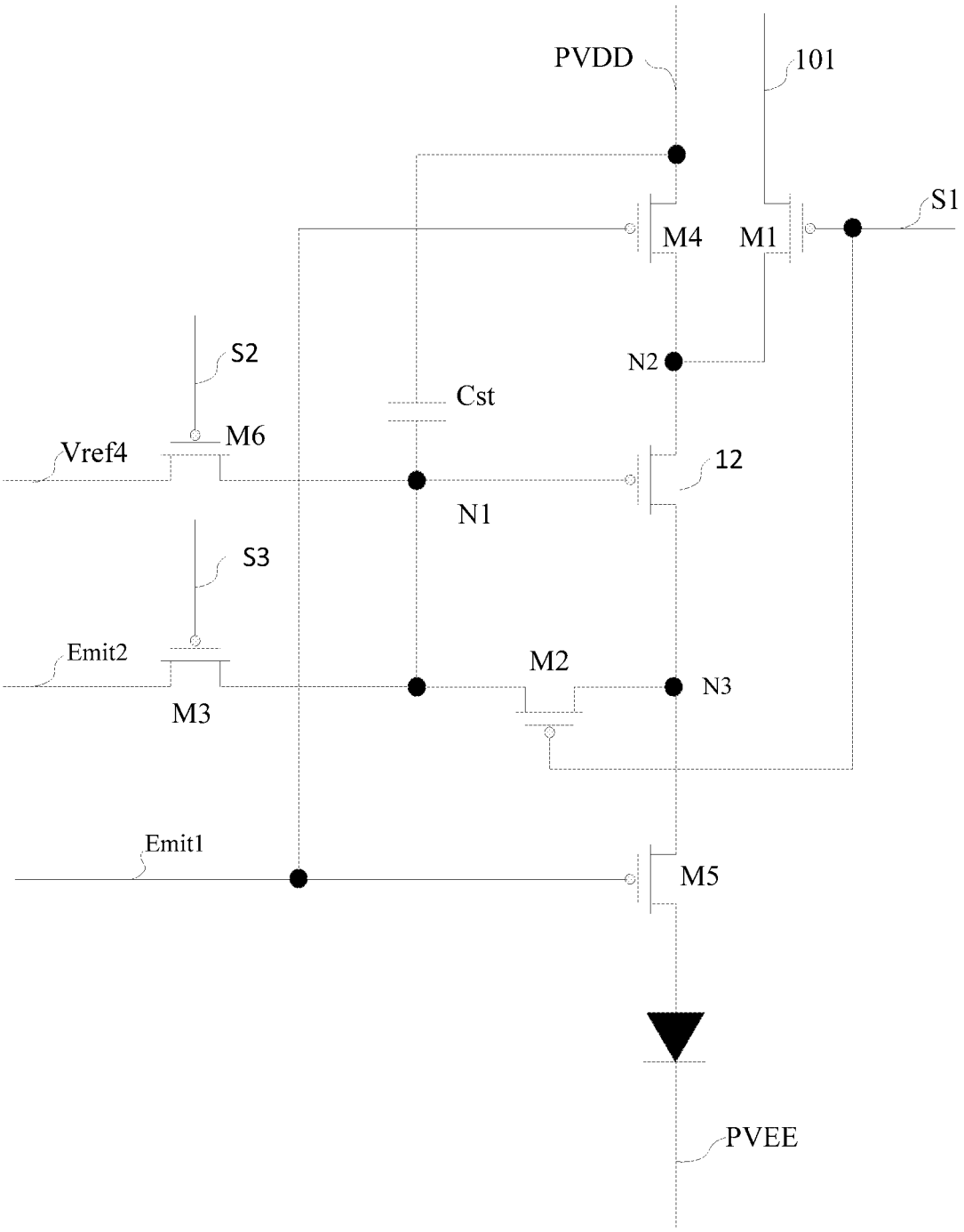
FIG. 3C is a circuit diagram of another pixel circuit according to an embodiment of the disclosure.
Figure 3D:
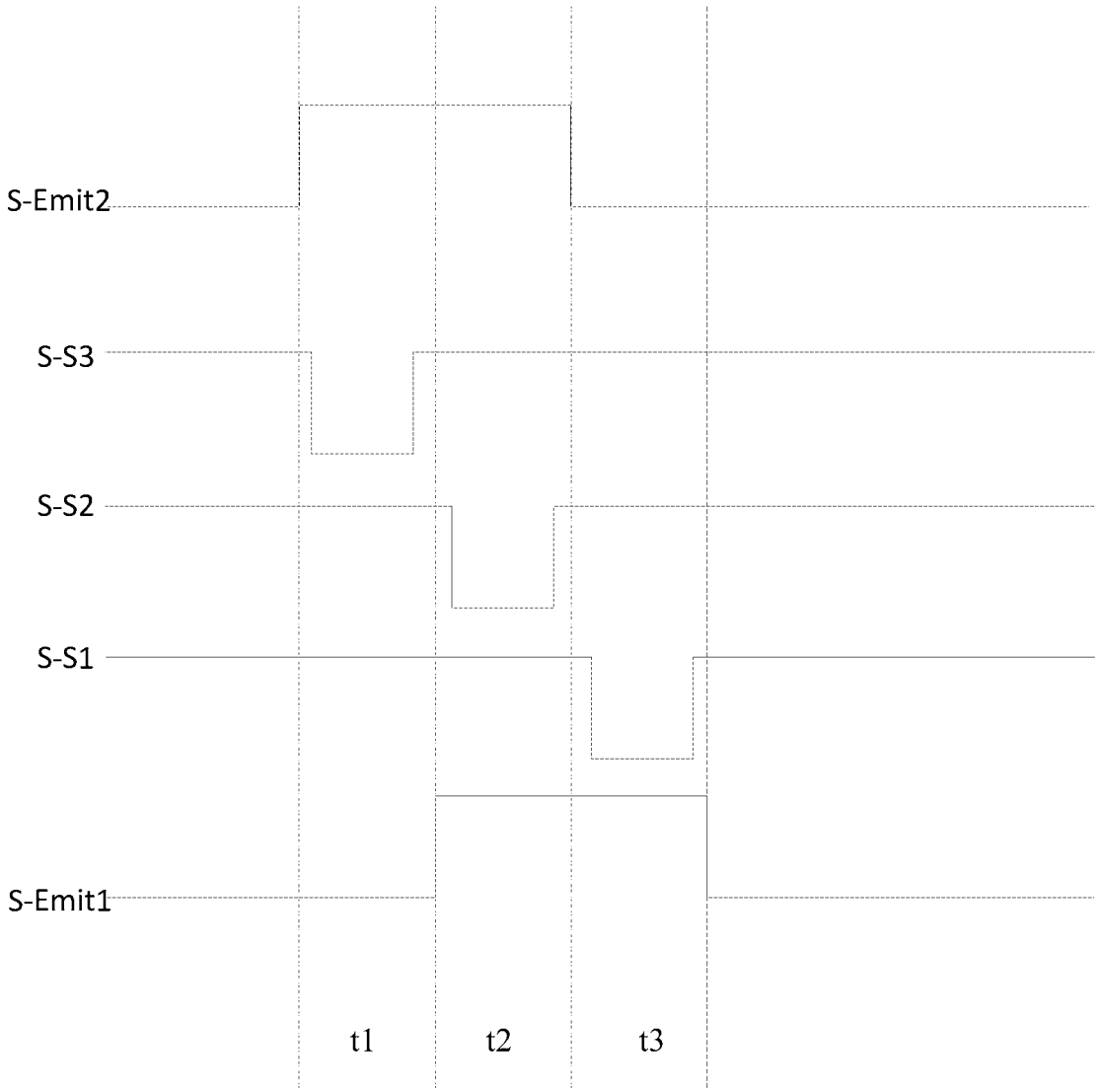
FIG. 3D is another drive timing diagram according to an embodiment of the disclosure.

FIG. 3C is a circuit diagram of another pixel circuit according to an embodiment of the disclosure. Referring to FIG. 3C, as different from the pixel circuit shown in FIG. 2D, the first electrode of the third transistor M3 is electrically connected with the second light-emitting signal line Emit2, and the gate electrode of the third transistor M3 is electrically connected with the third scan line S3. FIG. 3D is another drive timing diagram according to an embodiment of the disclosure. S-S3 represents the third scan signal on the third scan line S3, and S-Emit2 represents the second light-emitting signal on the second light-emitting signal line Emit2. In t1 stage, the third scan signal S-S3 is at a low level, the third transistor M3 is turned on, the high level of the second light-emitting signal S-Emit2 is written to the gate electrode of the drive transistor 12, and the drive transistor 12 operates in a full cut-off region. The turn-on or turn-off states and the signaling directions of the transistors in other stages may be referred to the description of the pixel circuit shown in FIG. 2D.

In an embodiment of the disclosure, the first transistor, the second transistor, the third transistor, the fourth transistor, the fifth transistor, the sixth transistor and the drive transistor may all be P-type transistors. In other embodiments of the disclosure, the first transistor, the second transistor, the third transistor, the fourth transistor, the fifth transistor, the sixth transistor and the drive transistor may all be N-type transistors. In the case that the drive transistor is an N-type transistor, the voltage difference between the gate electrode and the source electrode of the drive transistor may be smaller than the negative value of the threshold voltage thereof. In the cut-off stage, the voltage on the gate electrode of the drive transistor written by the third level signal line may be equal to the voltage value of the first scan signal in the low-level stage or the voltage value of the second light-emitting signal line in the low-level stage.

Figure 4A:
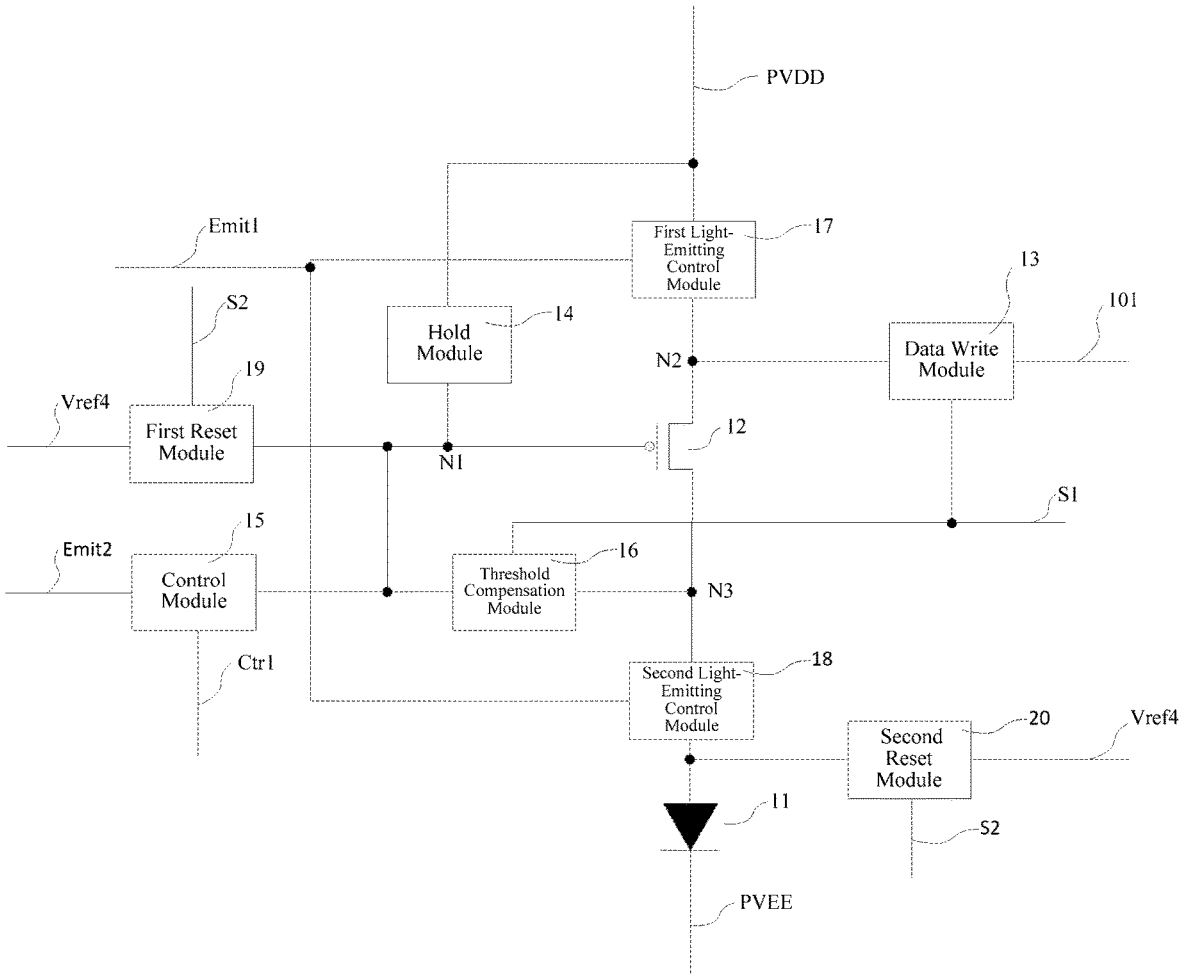
FIG. 4A is an electrical block diagram of another pixel circuit according to an embodiment of the disclosure.

FIG. 4A is an electrical block diagram of another pixel circuit according to an embodiment of the disclosure. On the basis of the above embodiments, the pixel circuit further includes a second reset device 20.

The control terminal of the second reset device 20 is electrically connected with the second scan line S2, the first terminal thereof is electrically connected with the fourth level signal line Vref4, and the second terminal thereof is electrically connected with the first electrode of the light-emitting element 11. When it is turned on, the second reset device may write the signal on the fourth level signal line Vref4 to the first electrode of the light-emitting element and reset the first electrode of the light-emitting element, thereby preventing the charges of the frame on the first electrode of the light-emitting element affecting the next frame, and hence improving the display effect.

Figure 4B:
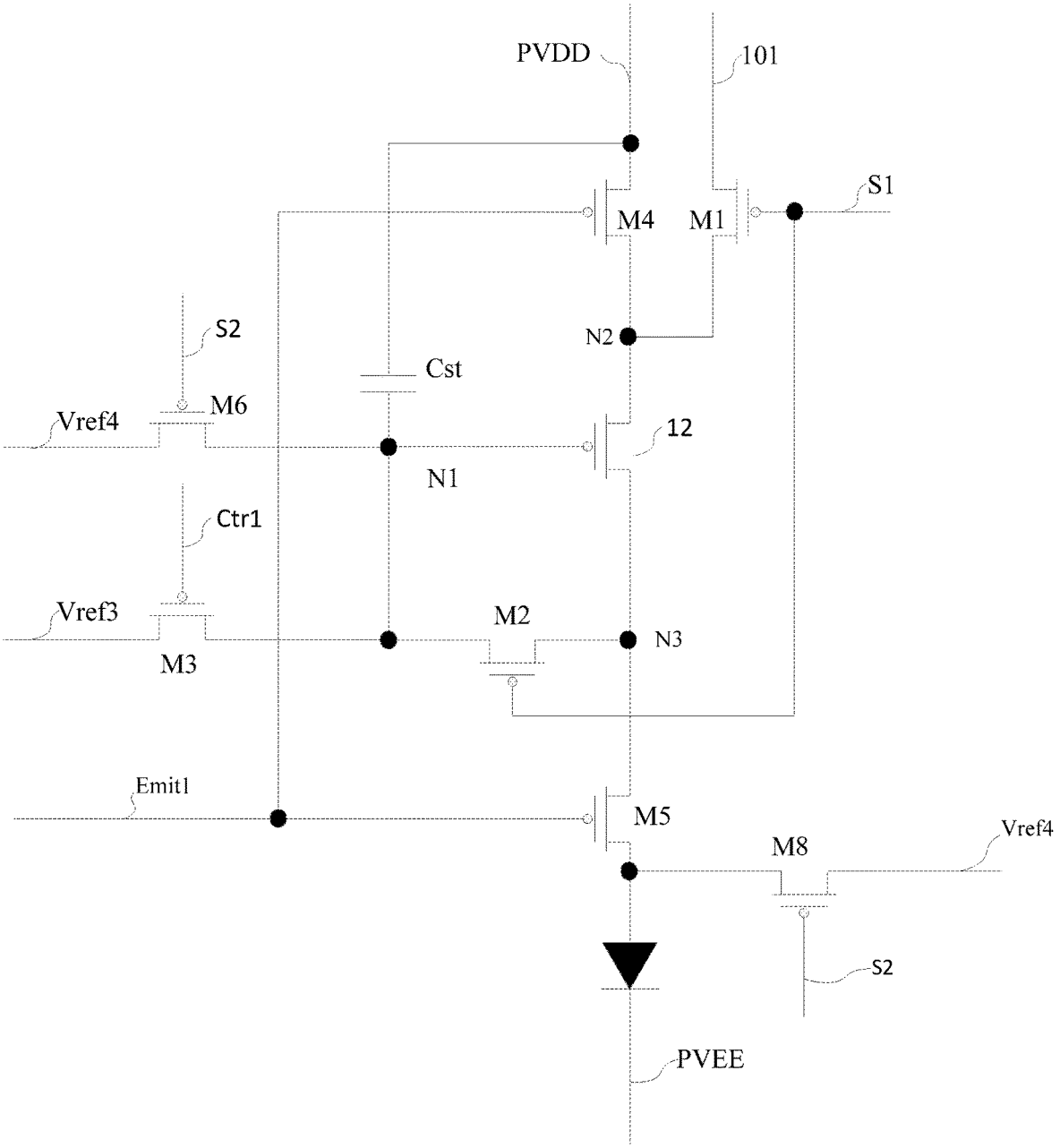
FIG. 4B is a circuit diagram of another pixel circuit according to an embodiment of the disclosure.

The second reset device 20 includes an eighth transistor. Exemplarily, FIG. 4B is a circuit diagram of a pixel circuit according to an embodiment of the disclosure. Referring to FIG. 4B, the second reset device includes an eighth transistor M8, and the first electrode of the eighth transistor M8 is electrically connected with the fourth level signal line Vref4, the second electrode of the eighth transistor M8 is electrically connected with the first electrode of the light-emitting element 11, and the gate electrode of the eighth transistor M8 is electrically connected with the second scan line S2.

Figure 5:
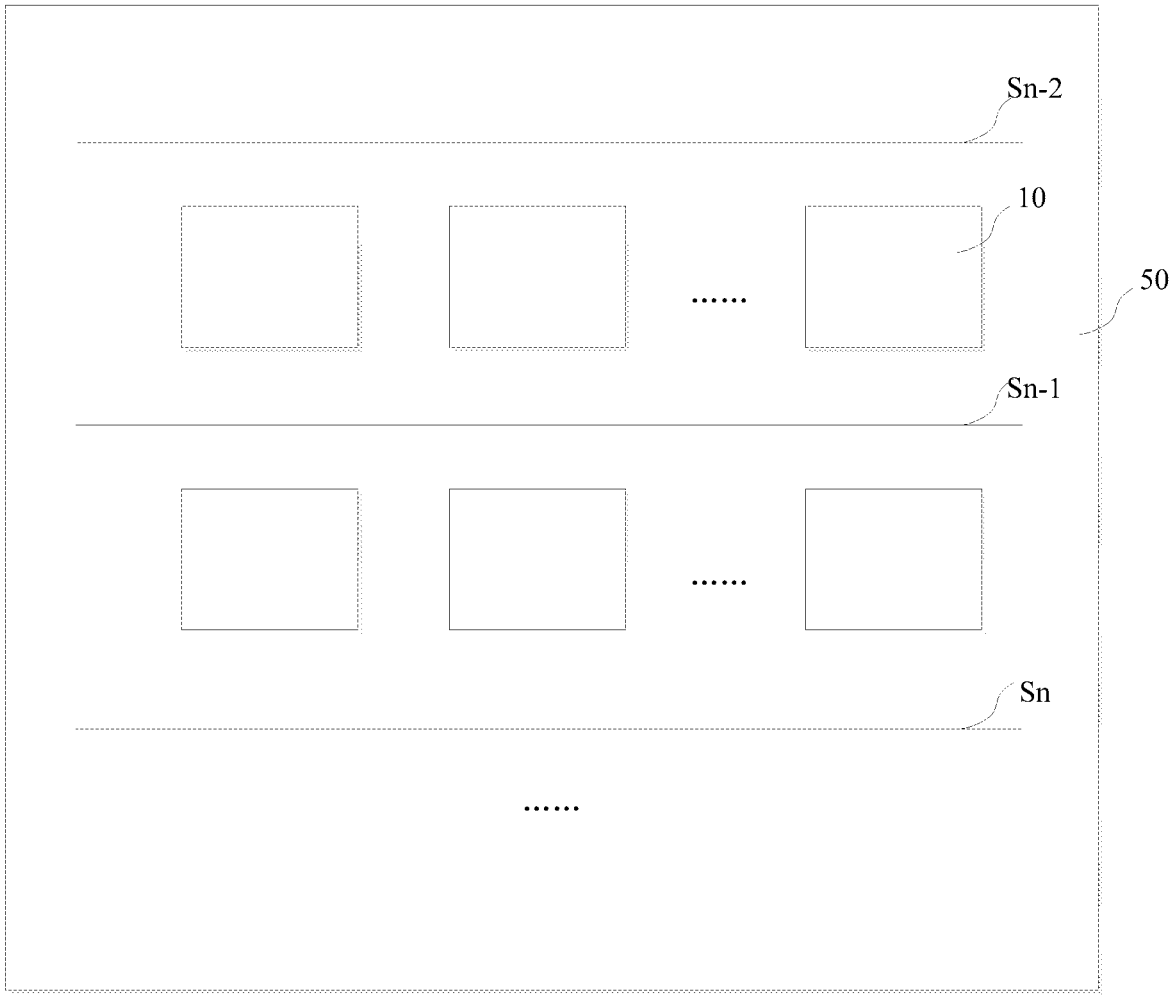
FIG. 5 is a schematic diagram of a display panel according to an embodiment of the disclosure.

An embodiment of the disclosure further provides a display panel. FIG. 5 is a schematic diagram of a display panel according to an embodiment of the disclosure. Referring to FIG. 5, the display panel 50 includes the pixel circuit 10 according to any embodiment of the disclosure, and Sn-2. Sn-1 and Sn represent scan lines.

Figure 6:
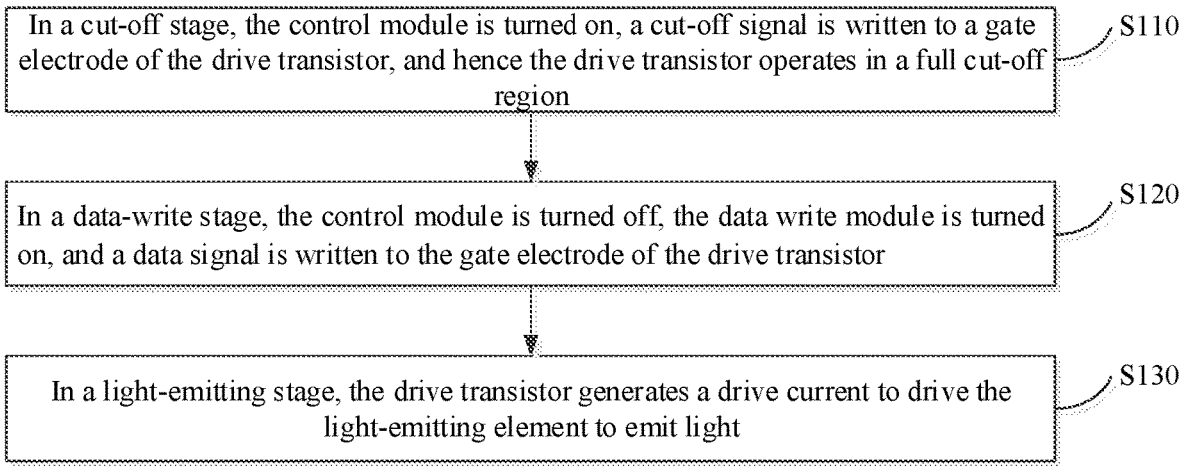
FIG. 6 is a schematic flow chart of a drive method for a pixel circuit according to an embodiment of the disclosure.

An embodiment of the disclosure further provides a drive method for a pixel circuit, which may be configured for driving the pixel circuit according to any of the embodiments of the disclosure to operate. FIG. 6 is a schematic flow chart of a drive method for a pixel circuit according to an embodiment of the disclosure. Referring to FIG. 6, the drive method for a pixel circuit according to an embodiment of the disclosure includes the following steps.

S110, in a cut-off stage, the control device is turned on, a cut-off signal is written to a gate electrode of the drive transistor, and hence the drive transistor operates in a full cut-off region.

The drive transistor operates in a full cut-off region, so that the degree of characteristic drift of the drive transistor may be lowered, thereby lowering the display mura and artifact, and improving the display effect.

S120: in a data-write stage, the control device is turned off, the data write device is turned on, and a data signal is written to the gate electrode of the drive transistor; and S130, in a light-emitting stage, the drive transistor generates a drive current to drive the light-emitting element to emit light.

Further, before the light-emitting stage, the method further includes a threshold compensation stage. In the threshold compensation stage, the threshold voltage of the drive transistor is compensated, and the hold device stores the voltage related to the threshold voltage of the drive transistor;

In the light-emitting stage, the drive transistor generates a drive current independent of the threshold voltage thereof, according to the voltage provided by the hold device.

Moreover, the pixel circuit further includes a first reset device, which is electrically connected with the gate electrode of the drive transistor;

After the cut-off stage and before the data-write stage, the method further includes an initialization stage.

In the initialization stage, the first reset device is turned on, and a reset voltage is written to one terminal of the hold device which is electrically connected with the gate electrode of the drive transistor, so that the gate voltage of the drive transistor and the voltage on the first terminal of the hold device may be reset in order to write a data signal to the gate electrode of the drive transistor in the data-write stage.

In the technical solutions of the embodiments of the disclosure, a control device is provided to control the transistor in the pixel circuit to operate in a full cut-off region in a part of the time period within one frame, so that the degree of voltage bias of the drive transistor is low, and thus the degree of characteristic drift of the drive transistor may be lowered, the degree of twist of the characteristic curve may be lowered, the display mura and artifact may be lowered, and hence the display effect of the picture may be improved. Moreover, by reusing the third scan signal line and the second light-emitting control signal line in the display panel to provide a drive signal for the control device, the drive transistor may be controlled to operate in a full cut-off region via the signal lines existing in the display panel and drive timing thereof, thus saving the wirings in the display panel and saving the wiring space.

What is claimed is:

1. A pixel circuit, comprising:

a light-emitting element, which is configured for emitting light in response to a drive current;

a drive transistor, which is configured for providing the drive current to the light-emitting element;

a first transistor, a gate electrode of the first transistor is electrically connected with a first scan line, a first terminal of the first transistor is electrically connected with a data line, and a second terminal of the first transistor is electrically connected with the first electrode of the drive transistor;

a first capacitor, which is configured for holding a voltage on the gate electrode of the drive transistor in a light-emitting stage, wherein a first electrode of the first capacitor is electrically connected with the gate electrode of the drive transistor, and a second electrode of the first capacitor is directly electrically connected with a first level signal line;

a third transistor, which is configured for controlling the drive transistor to operate in a full cut-off region in a cut-off stage, wherein the cut-off stage precedes the light-emitting stage, and wherein a first electrode of the third transistor is electrically connected with one of a third level signal line and a second light-emitting signal line, a second electrode of the third transistor is electrically connected with the gate electrode of the drive transistor through a first node, and a gate electrode of the third transistor is electrically connected with a control signal line;

a fourth transistor, wherein a control terminal of the fourth transistor is electrically connected with a first light-emitting signal line, a first terminal of the fourth transistor is electrically connected with the first level signal line, and a second terminal of the fourth transistor is electrically connected with a first electrode of the drive transistor;

a fifth transistor, wherein a control terminal of the fifth transistor is electrically connected with the first light-emitting signal line, a first terminal of the fifth transistor is electrically connected with a second electrode of the drive transistor, and a second terminal of the fifth transistor is electrically connected with a first electrode of the light-emitting element; and a sixth transistor, wherein a control terminal of the six transistor is electrically connected with a second scan line, a first terminal of the six transistor is electrically connected with a fourth level signal line, and a second terminal of the six transistor is electrically connected with the gate electrode of the drive transistor and the first electrode of the first capacitor through the first node;

wherein in the cut-off stage, the fourth transistor and the fifth transistor are turned on under control of a logic low-level first light-emitting signal from the first light-emitting signal line so that a logic high-level signal from the first level signal line is written to the first electrode of the drive transistor, the third transistor is turned on under control of a logic low-level control signal from the control signal line so that a logic high-level signal from the third level signal line is written to the gate electrode of the drive transistor through the first node, and the drive transistor is configured to be worked in the full cut-off region.

2. The pixel circuit as claimed in claim 1, wherein, the drive transistor is one of an N-type transistor and a P-type transistor;

wherein in order to control the drive transistor to operate in the full cut-off region in the cut-off stage, if the drive transistor is the N-type transistor, a voltage difference between the gate electrode and a source electrode of the drive transistor is smaller than a negative value of the threshold voltage thereof; and if the drive transistor is the P-type transistor, the voltage difference between the gate electrode and the source electrode of the drive transistor is larger than the negative value of the threshold voltage thereof.

3. The pixel circuit as claimed in claim 1, further comprising: a second transistor;

wherein a gate electrode of the second transistor is electrically connected with the first scan line, a first terminal of the second transistor is electrically connected with a second electrode of the drive transistor, and a second terminal of the second transistor is electrically connected with the gate electrode of the drive transistor; and wherein a second electrode of the light-emitting element is electrically connected with a second level signal line.

4. The pixel circuit as claimed in claim 1, wherein, a voltage value of a signal on the third level signal line is larger than a voltage value of a signal on the first level signal line.

5. The pixel circuit as claimed in claim 1, wherein signals on the first light-emitting signal line and the second light-emitting signal line are both impulse signals; and the signal on the second light-emitting signal line is a signal immediately preceding to the signal on the first light-emitting signal line.

6. The pixel circuit as claimed in claim 5, wherein the signal on the second light-emitting signal line is an impulse signal; and a voltage value of a high-level signal on the second light-emitting signal line is larger than a voltage value of the signal on the first level signal line.

7. The pixel circuit as claimed in claim 3, wherein signals on the control signal line, the first scan line and the second scan line are all impulse signals; and the signal on the second scan line is a signal immediately preceding to the signal on the first scan line.

8. The pixel circuit as claimed in claim 7, wherein, the gate electrode of the third transistor is electrically connected with a third scan line, the signal on the third scan line is an impulse signal, and the signal on the third scan line is a signal immediately preceding to the signal on the second scan line, and the third scan line is reused as the control signal line.

9. The pixel circuit as claimed in claim 3, wherein the first transistor, the second transistor, the third transistor, the fourth transistor, the fifth transistor, the sixth transistor and the drive transistor are all P-type transistors.

10. The pixel circuit as claimed in claim 3, further comprising: an eighth transistor, wherein a first electrode of the eighth transistor is electrically connected with the fourth level signal line, a second electrode of the eighth transistor is electrically connected with the first electrode of the light-emitting element, and a gate electrode of the eighth transistor is electrically connected with the second scan line.

11. A display panel, comprising:

a pixel circuit, wherein the pixel circuit comprises:

a light-emitting element, which is configured for emitting light in response to a drive current;

a drive transistor, which is configured for providing the drive current to the light-emitting element;

a first transistor, a gate electrode of the first transistor is electrically connected with a first scan line, a first terminal of the first transistor is electrically connected with a data line, and a second terminal of the first transistor is electrically connected with the first electrode of the drive transistor;

a first capacitor, which is configured for holding a voltage on the gate electrode of the drive transistor in a light-emitting stage, wherein a first electrode of the first capacitor is electrically connected with the gate electrode of the drive transistor, and a second electrode of the first capacitor is directly electrically connected with a first level signal line;

a third transistor, which is configured for controlling the drive transistor to operate in a full cut-off region in a cut-off stage, wherein the cut-off stage precedes the light-emitting stage, and wherein a first electrode of the third transistor is electrically connected with one of a third level signal line and a second light-emitting signal line, a second electrode of the third transistor is electrically connected with the gate electrode of the drive transistor through a first node, and a gate electrode of the third transistor is electrically connected with a control signal line;

a fourth transistor, wherein a control terminal of the fourth transistor is electrically connected with a first light-emitting signal line, a first terminal of the fourth transistor is electrically connected with the first level signal line, and a second terminal of the fourth transistor is electrically connected with a first electrode of the drive transistor;

a fifth transistor, wherein a control terminal of the fifth transistor is electrically connected with the first light-emitting signal line, a first terminal of the fifth transistor is electrically connected with a second electrode of the drive transistor, and a second terminal of the fifth transistor is electrically connected with a first electrode of the light-emitting element; and a sixth transistor, wherein a control terminal of the six transistor is electrically connected with a second scan line, a first terminal of the six transistor is electrically connected with a fourth level signal line, and a second terminal of the six transistor is electrically connected with the gate electrode of the drive transistor and the first electrode of the first capacitor through the first node;

wherein in the cut-off stage, the fourth transistor and the fifth transistor are turned on under control of a logic low-level first light-emitting signal from the first light-emitting signal line so that a logic high-level signal from the first level signal line is written to the first electrode of the drive transistor, the third transistor is turned on under control of a logic low-level control signal from the control signal line so that a logic high-level signal from the third level signal line is written to the gate electrode of the drive transistor through the first node, and the drive transistor is configured to be worked in the full cut-off region.

12. A drive method for a pixel circuit, which is configured for driving a pixel circuit, wherein the pixel circuit comprises:

a light-emitting element, which is configured for emitting light in response to a drive current;

a drive transistor, which is configured for providing the drive current to the light-emitting element;

a first transistor, a gate electrode of the first transistor is electrically connected with a first scan line, a first terminal of the first transistor is electrically connected with a data line, and a second terminal of the first transistor is electrically connected with the first electrode of the drive transistor;

a first capacitor, which is configured for holding a voltage on the gate electrode of the drive transistor in a light-emitting stage, wherein a first electrode of the first capacitor is electrically connected with the gate electrode of the drive transistor, and a second electrode of the first capacitor is directly electrically connected with a first level signal line;

a third transistor, which is configured for controlling the drive transistor to operate in a full cut-off region in a cut-off stage, wherein the cut-off stage precedes the light-emitting stage, and wherein a first electrode of the third transistor is electrically connected with one of a third level signal line and a second light-emitting signal line, a second electrode of the third transistor is electrically connected with the gate electrode of the drive transistor through a first node, and a gate electrode of the third transistor is electrically connected with a control signal line;

a fourth transistor, wherein a control terminal of the fourth transistor is electrically connected with a first light-emitting signal line, a first terminal of the fourth transistor is electrically connected with the first level signal line, and a second terminal of the fourth transistor is electrically connected with a first electrode of the drive transistor;

a fifth transistor, wherein a control terminal of the fifth transistor is electrically connected with the first light-emitting signal line, a first terminal of the fifth transistor is electrically connected with a second electrode of the drive transistor, and a second terminal of the fifth transistor is electrically connected with a first electrode of the light-emitting element; and a sixth transistor, wherein a control terminal of the six transistor is electrically connected with a second scan line, a first terminal of the six transistor is electrically connected with a fourth level signal line, and a second terminal of the six transistor is electrically connected with the gate electrode of the drive transistor and the first electrode of the first capacitor through the first node;

wherein the drive method comprises the following stages:

the cut-off stage, in which the fourth transistor and the fifth transistor are turned on under control of a logic low-level first light-emitting signal from the first light-emitting signal line so that a logic high-level signal from the first level signal line is written to a first electrode of the drive transistor, the third transistor is turned on under control of a logic low-level control signal from the control signal line so that a logic high-level signal from the third level signal line is written to the gate electrode of the drive transistor through the first node, and thus the drive transistor operates in the full cut-off region;

a data-write stage, in which the third transistor is turned off, the first transistor is turned on, and hence the data signal is written to the gate electrode of the drive transistor; and the light-emitting stage, in which the drive transistor generates the drive current to drive the light-emitting element to emit light.

13. The drive method as claimed in claim 12, wherein, before the light-emitting stage, the drive method further comprises: a threshold compensation stage, in which a threshold voltage of the drive transistor is compensated, and the hold device stores a voltage related to the threshold voltage of the drive transistor; and wherein in the light-emitting stage, the drive transistor generates the drive current independent of the threshold voltage thereof according to a voltage provided by the first capacitor.

14. The drive method as claimed in claim 13, wherein after the cut-off stage and before the data-write stage, the drive method further comprises an initialization stage; and in the initialization stage, the sixth transistor is turned on, and a reset voltage is written to one terminal of the first capacitor which is electrically connected with the gate electrode of the drive transistor.

* * * * *